US005135172A

United States Patent [19]

Toth

[11] Patent Number: 5,135,172

[45] Date of Patent: Aug. 4, 1992

[54] HIGH VOLUME LOW PRESSURE SPRAY GUN

[75] Inventor: Denis W. Toth, Waterford, Mich.

[73] Assignee: Can-Am Engineered Products, Inc., Livonia, Mich.

[21] Appl. No.: 641,126

[22] Filed: Jan. 14, 1991

[51] Int. Cl.[5] ..... B05B 1/04

[52] U.S. Cl. ..... 239/297; 239/300

[58] Field of Search ..... 239/290, 296, 297, 300

[56] References Cited

U.S. PATENT DOCUMENTS

| | | | |
|---|---|---|---|
| 2,146,416 | 2/1939 | Bramsen et al. | 239/300 |
| 2,470,718 | 5/1949 | Peeps | 239/300 |
| 2,708,095 | 5/1955 | Mitchell | 239/300 X |
| 2,737,415 | 3/1956 | Wheeler-Nicholson | 239/290 X |
| 2,864,649 | 12/1958 | Adams | 239/300 |
| 2,880,940 | 4/1959 | Briggs | 239/290 X |
| 3,168,250 | 2/1965 | Paasche | 239/300 |
| 4,744,518 | 5/1988 | Toth | 239/300 X |
| 4,993,633 | 2/1991 | Mellette | 239/300 X |
| 5,064,119 | 11/1991 | Mellette | 239/300 X |
| 5,080,285 | 1/1992 | Toth | 239/300 |

*Primary Examiner*—Andres Kashnikow
*Assistant Examiner*—William Grant
*Attorney, Agent, or Firm*—Weintraub, DuRoss & Brady

[57] ABSTRACT

A paint spray gun including a housing, an assembly and an air cap for controlling paint fanning. An air restrictor limits the total air cap pressure, such that it may emit a high volume of spray at a low air cap pressure. The restriction of pressure is achieved by restricting air flow within the housing by an enlarged section of a central rod which cooperates with a bore forward in the bolt, which connects the housing to the assembly. Movement of the rod controls both the valve movement and the pressure.

8 Claims, 4 Drawing Sheets

HIGH VOLUME LOW PRESSURE SPRAY GUN

BACKGROUND OF THE INVENTION

1. Field of the Invention

The present invention relates generally to spray guns for applying a stream of paint under pressure. More specifically, the present invention relates to a controlled fan spray gun with a high volume paint output and a low total air pressure in the air cap, or discharge end, of the spray gun.

2. Description of the Related Art

In conventional paint spray guns, a stream of paint under pressure is discharged from a relatively small orifice in a nozzle while air under pressure is discharged radially inwardly into the stream from an annular opening surrounding the nozzle closely adjacent the paint discharge orifice to atomize the stream of paint into a spray of fine particles. The spray thus produced moves away from the gun in an expanding or conical pattern whose apex is at the nozzle.

It is frequently desired to modify, or control, the circular cross-section, or fan, of the normally conical spray pattern by transforming this pattern into one of a narrowed and elongated, generally elliptically shaped cross-section, so that the spray pattern is that of a flat sided fan. This is done by diverting pressurized air within the air cap of the gun laterally into the conical spray emerging from the nozzle, as is well known in the art.

Heretofore such spray guns were largely run on pressurized air lines or tanks at air pressures which caused a large percentage of the paint to bounce back from the surface being painted. This "bounce-back" of paint and the solvents therein wastes paint, or other sprayed coating materials, and pollutes the atmosphere.

In order to decrease this pollution, governmental agencies have enacted regulations to limit the total air pressure available to atomize and propel paint at the discharge end of the spray gun or air cap.

In spite of these regulations, due to inherent design constraints, the delivery systems for pressurized air generally run at pressures higher than the maximum allowable pressure, e.g., 10 psi maximum total air cap pressure is currently required under California law. Thus, the air flowing into the spray gun must be regulated before reaching the air cap.

It is known in the art to have a variable position restrictor plug placed in the air intake passages as disclosed in U.S. Pat. No. 4,187,872. However, this patent discloses no fixed air metering air cap pressure unlike the present invention.

In applicant's prior U.S. Pat. No. 4,744,518, to control the fan of the output spray, there is taught a sliding valve means between the atomizing air and fanning air channels, the disclosure of which is hereby incorporated by reference.

Another known method for regulating air pressure to a spray gun air cap is provided in a single-metering spray gun manufactured by Binks Manufacturing Co. The Binks spray gun places a pierced air restrictor collar, or baffle, and a control rod within an air intake channel. The control rod regulates the flow between a fanning air chamber and an atomizing air chamber formed in the air cap by adjustably locating a tapered end thereof at the intake of the chambers. The restrictor collar, which is a plastic disc provided with restriction orifices, allows only a predetermined air pressure to proceed through the air intake channel to the cap. The Binks single-metering system is designed as a part of a unitary spray gun assembly. This system necessarily requires replacement of the user's current spray gun with a new gun.

It becomes apparent that what is needed in response to lowered air cap pressure regulations in the spray gun art is a device which allows owners of spray guns, currently unable to meet air cap pressure standards, to retrofit their existing guns with an assembly which permits meeting the air pressure standards, while maintaining the operational capabilities of state of the art spray guns as to fan control, paint volume etc. Such a retrofit device should further provide components with design flexibility in meeting the standards, preferably with the minimal amount of machining necessary for such components, i.e., a simplicity of design to yield manufacturing savings in tooling, man hours, and material. By the same token, such a "retrofit" assembly can be employed as part of a new gun. It is to this to which the present invention is directed.

SUMMARY OF THE INVENTION

The present invention provides a paint spray gun which meets lowered total air cap pressure requirements while enabling high volume, low pressure spray application.

The present invention includes a main housing, having a forward end and a rearward end. An assembly, having a forward end and a rearward end, is mounted on to the housing, the rearward end of the assembly mounting on to the forward end of the housing. An annular air cap is mounted at the forward end of the assembly. The air cap has a central discharge opening extending coaxially therethrough. A nozzle is mounted onto the assembly, coaxially of the air discharge orifice at its forward end for discharging paint under pressure.

The assembly provides a central passage for supplying paint, under pressure, to a nozzle, positioned at the discharge opening. The housing provides a first passage for supplying air under pressure to the assembly. The assembly includes a second passage, communicating with the first passage, for supplying air, under pressure, to a chamber wherefrom it flows to the discharge opening to atomize paint discharged from the nozzle. The chamber also directs air to the air cap, which discharges air from diametrically opposed ports or channels to control fanning of the spray.

The assembly, also, includes a slidably adjustable valve for adjusting the flow of air from the chamber to the nozzle end to the air cap, the atomizing air and fanning air being discharged from the single chamber.

The nozzle, having a central bore, has a needle valve and means for moving needle the valve, the needle valve being disposed within the central bore of the nozzle.

The present invention, also, provides means for adjustably positioning the valve.

The present invention provides for improved reduction of air cap pressure. This is a means for restricting air flow or adjustment member which is disposed in the first and second passages. The adjustment member includes a rod having a raised circumference along its medial portion, the member attaching to the valve in the assembly and which member acts to restrict air flow and increase pressure within the housing.

A means for interconnecting the housing to the assembly, such as a bored bolt or the like, is disposed, thereby fluidly connecting the first and second passages. The bored bolt cooperates with the adjustment member, which passes through it, to limit air flow and therefore air pressure.

The assembly can be retrofitted to the housing of an existing paint spray gun by attachment at existing mechanical connection points. Likewise, an entire new gun can be manufactured which incorporates the features of the present invention.

Other attendant advantages will be more readily appreciated as the same becomes better understood by reference to the following detailed description and considered in connection with the accompanying drawings in which like reference numerals designate like parts throughout the figures.

BRIEF DESCRIPTION OF THE DRAWINGS

FIG. 3 is a cross-sectional view of a second embodiment of the present invention, and.

DETAILED DESCRIPTION OF THE PREFERRED EMBODIMENT

Figure 1:
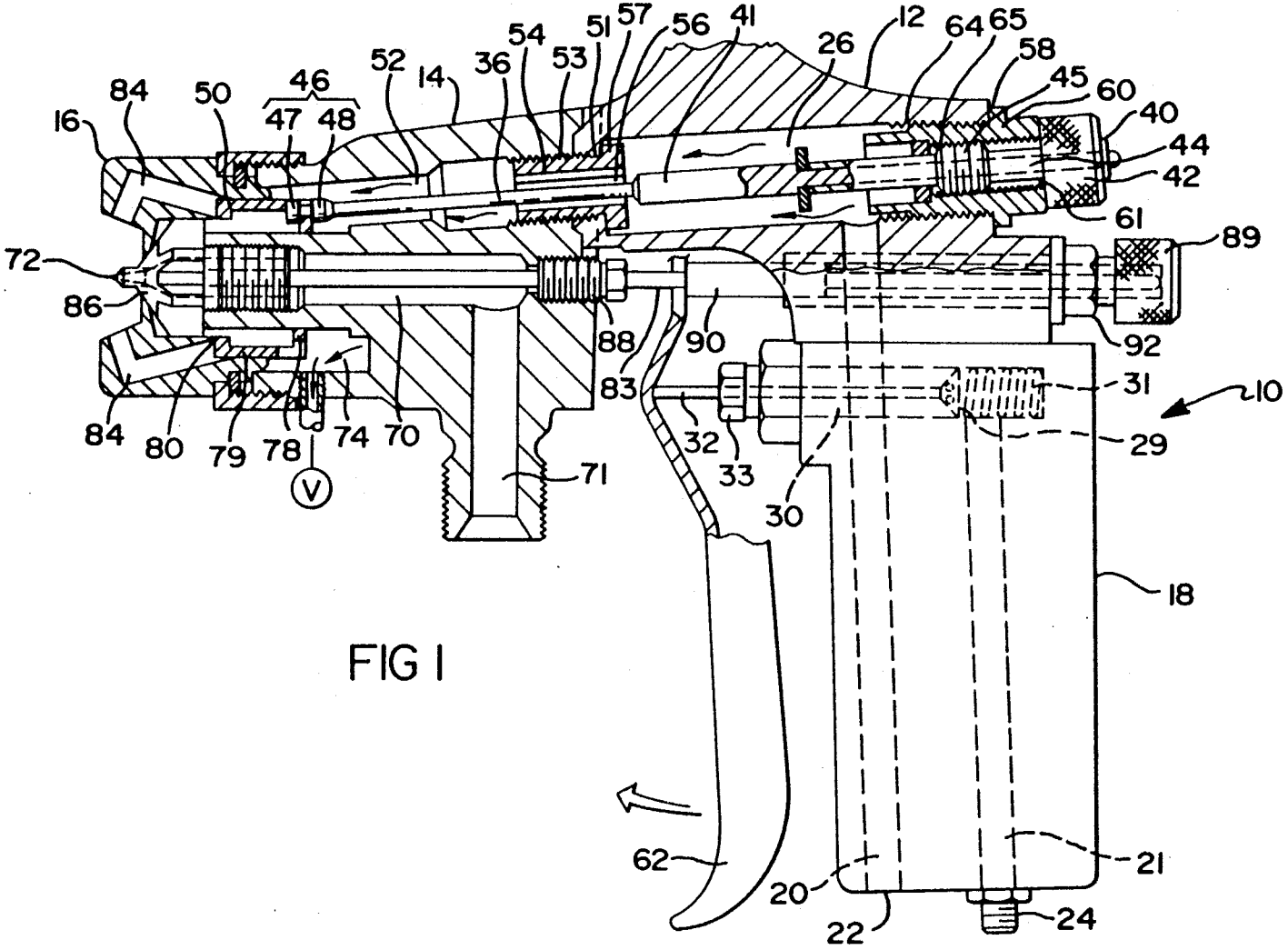
FIG. 1 is a cross-sectional view of a paint spray gun according to the present invention.
Figure 2:
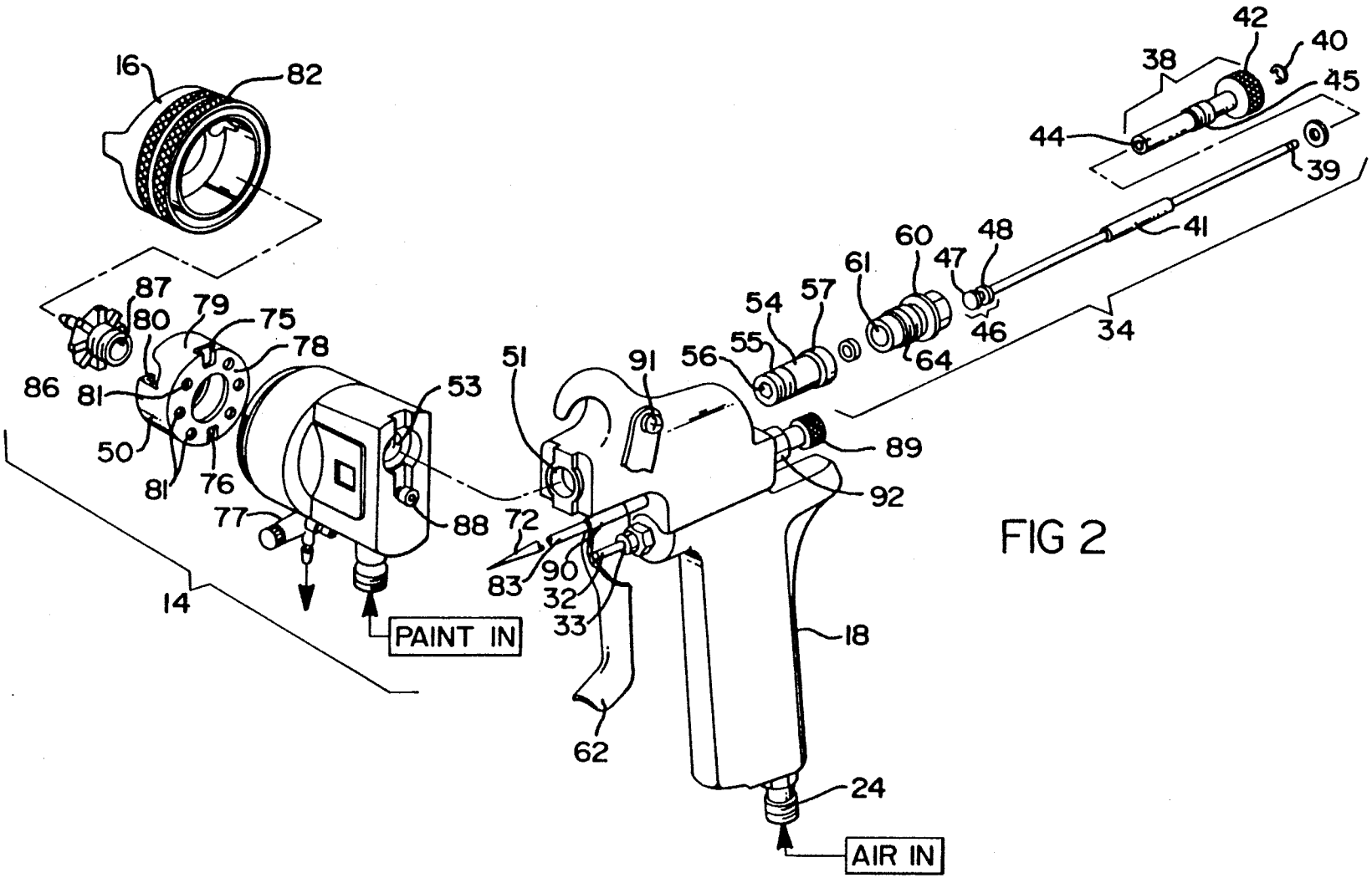
FIG. 2 is an exploded perspective view of a paint spray gun in accordance herewith.

Referring to FIGS. 1 and 2, a spray gun 10 in accordance with the present invention can be seen. The gun 10, generally, includes a housing 12, an assembly 14 connected to the housing 12 and an air cap 16 mounted to the assembly 14. As shown in FIGS. 1 and 2, the housing 12 includes a handle 18. A first bore 20 and a second bore 21 are formed in the handle 18. A plug 22 disposed at the bottom of the handle 18 seals the first bore 20. A fitting 24 is threadably connected to the handle 18 at the end of the second bore 21. A source of pressurized air (not shown) is attached to the fitting 24.

An interior passage 26 is, also, formed in the housing 12. The passage 26 defines a first passage.

The first bore 20 extends from the bottom or base of the handle 18 to the first passage 26 and is in fluid communication therewith.

An air valve assembly 28 is disposed at the forward end of the handle 18. The air valve assembly 28 comprises a spring-biased valve 29 disposed in a bore 30. The valve 29 is seated on a shaft 32 by any suitable means, such as by a threaded attachment or the like. The shaft 32 is interfaced by a trigger 62, the trigger 62 being operable to move rearwardly the spring-biased valve 29 to provide fluid communication between the first bore 20, the second bore 21 and the bore 30, thereby allowing pressurized air to pass through the second bore 21 to the first passage 26.

Disposed within the first passage 26 is a means for restricting air flow 34. The means for restricting air flow 34 comprises a rod 36 having a first end secured within a threaded housing 38 by a c-clip 40 or other suitable fastener, such as a nut or the like.

The housing 38 generally comprises a knurled knob 42 and a hollow cylindrical portion 44 integrally formed therewith. The cylindrical portion 44 of the housing 38 has a threaded profile 45 formed on the outer surface thereof.

The cylindrical portion 44 of the housing 38 seats within the passage 26 while the knob 42 is disposed exteriorly thereof, as shown.

The rod 36 has a forward end 37 and rearward end 39. A keeper 46 is formed by the cooperation of two raised circumferences 47, 48 on the rod 36. The keeper 46 is attached to a sliding valve 50 disposed in the assembly 14 in a manner to be described hereinafter. A raised circumference 41 is disposed medially upon the rod 36.

As shown, the first passage 26 is formed within the housing 12 and is of sufficient length to accommodate the rod 36. The passage 26 has a first opening 51 formed at the forward end of the housing 52 and is in registry with a second passage 40 formed in the assembly 14. A bolt 54 having a threaded exterior 55 and a central bore 56 is used to interconnect the housing 12 and the assembly 14 and is disposed within the first passage 26 and second passage 52.

As shown in the drawing, the bolt 54 has a flange 57 integrally formed therewith to retain the bolt in the first passage 26. The second passage 52 has a threaded entry 53 to permit the bolt 54 to threadably connect thereto.

The rod 36 extends through the bore 56 of the bolt 54 into the passage 52.

As subsequently detailed, the raised circumference 41 cooperates with the bore 56 of the bolt 54 to restrict air flow from the first passage 26 into the second passage 52.

The passage 26 has a second or rearward threaded opening 58 at its opposite end. A bored plug 60 is inserted into the rearward opening 58. The plug 60 has a through bore 61 formed centrally thereof. The plug 60 has a threaded profile both on its exterior surface 64 and its interior bore 65, as shown. The rearward opening 58 is threaded in a manner corresponding to that of the plug 60. Likewise, the cylindrical portion 44 has its thread correspond to the thread of the interior bore of the plug 60. By the cooperation between the opening 58, plug 60, and the threaded housing 35, the rearward opening 58 is sealed, while the means for restricting air flow 34 can be moved forwardly or rearwardly by rotating the knob 42, causing the rod 36 to advance or retract.

The assembly 14, in addition to the second passage 52, has a central passage 70 longitudinally extending therethrough. The passage 70 is employed to deliver paint. A bore 71 registers with the passage 70 and is in fluid communication therewith. The bore 71 is operatively connected to a source of paint (not shown) such that paint flows through the bore 71 and into the first passage 70.

A shaft or needle rod 83 extends through the central passage 70. The free end or terminus of the shaft defines a needle valve 72 for regulating the flow of paint through the passage 70.

A chamber 74 is formed about the central passage 70. The valve 50 is seated within the chamber 74. Furthermore, the chamber 74 is in fluid communication with the second passage 52. Thus, pressurized air flows from the second passage 52 into the chamber 74 and the valve is used to regulate the flow of air from the chamber 74.

The valve 74 has a notch 75 formed therein. The keeper 46 provided on the rod 36 fits into and is retained by the notch 75. Thus, as the knob 42 is rotated, the valve 50 moves in direct response thereto to alter the air flow forward thereof in the chamber 74.

The valve 50 has a groove 76 formed therein. A pressure relief valve 77 extends into the chamber 74 and seats in the groove 76 to prevent rotation of the valve 50 and guide the movement of the valve 50.

The valve 50, as shown in FIG. 2, is a cylindrical member having an end wall 78 and cylindrical side wall 79. A flange 80 extends exteriorly from the free end of the wall. Thus, the valve 50 is a substantially hollow cylindrical member. A plurality of apertures 81 are formed circumferentially about the end wall 78. In use, air from the second passage 52 flows through these apertures 81. Because of the size of the apertures 81 being smaller than the area of the second passage 52, the velocity of the air flowing therethrough increases.

The valve 50 controls the flow of pressurized air into the air cap 16. The air cap 16 is threadably secured to the assembly 14 via a rotatable ring 82. A pair of spaced apart channels or ports 84 are formed in the air cap 16 and are in fluid communication with the chamber 74. The channels 84 define the means of fanning the paint, in a manner described hereinbelow.

As shown in the drawing, the central passage 70 is closed at its forward end by a nozzle 86. The nozzle 86 has a central bore 87 whose opening and closing is controlled by the needle rod or shaft 83. The needle rod 83 is retracted rearwardly through the central passage 70 and out of the assembly 14 at an opening 88. The needle rod 83 continues rearwardly, entering the housing 12 through a bored bolt 92. The needle rod 83 is connected to a knob 89, through which the forward position of the needle rod 83 can be altered. The needle rod 83 has a raised circumference 90, located medially in the rod 83. The rod 83 is interfaced at the raised circumference 90 by a trigger 62. The trigger 62 is attached to the housing 12 at a pin 91, the trigger pivoting off pin 91. By pulling the trigger 62 rearwardly, the needle rod 83 is drawn rearwardly by the action of the trigger 62 upon the raised circumference 90. The needle rod 83 is withdrawn from the central bore 87 of the nozzle 86, allowing the material to be sprayed to be dispersed.

Thus, by the rearward drawing of the shaft 83 by the trigger 62, the nozzle 86 is opened, while pressurized air travels from the second boring 21, through the air valve assembly 28, into the first boring 20, into and through the first passage means 26, into and through the second passage means 52, into the chamber 74, through the valve 50 and out past the nozzle 86, atomizing the material to be sprayed.

In use, the knurled knob 42 is used to control the pressure of air traveling from the first passage 26 to the second passage 52. By the extension or retraction of the rod 36, the raised circumference 41 moves closer or farther from the bore 56 formed in the bolt 54, thus, regulating the pressure and velocity of the air flowing into the passage 52.

Likewise, extension or retraction of the rod 36 causes movement of the valve 50. In its forwardmost position in the chamber 74, the valve 50 precludes any fanning air from passing into the ports 84. As the rod 36 is retracted the flow of air into the ports 84 is increased since the valve 50 is being drawn rearwardly in the chamber 74. As the amount of fanning air is increased the amount of nozzle air provided from the passage 52 is decreased. This single chamber 74 air splitting through the valve 50 is more particularly described in the above-referred to U.S. Pat. No. 4,744,518.

Figure 3:
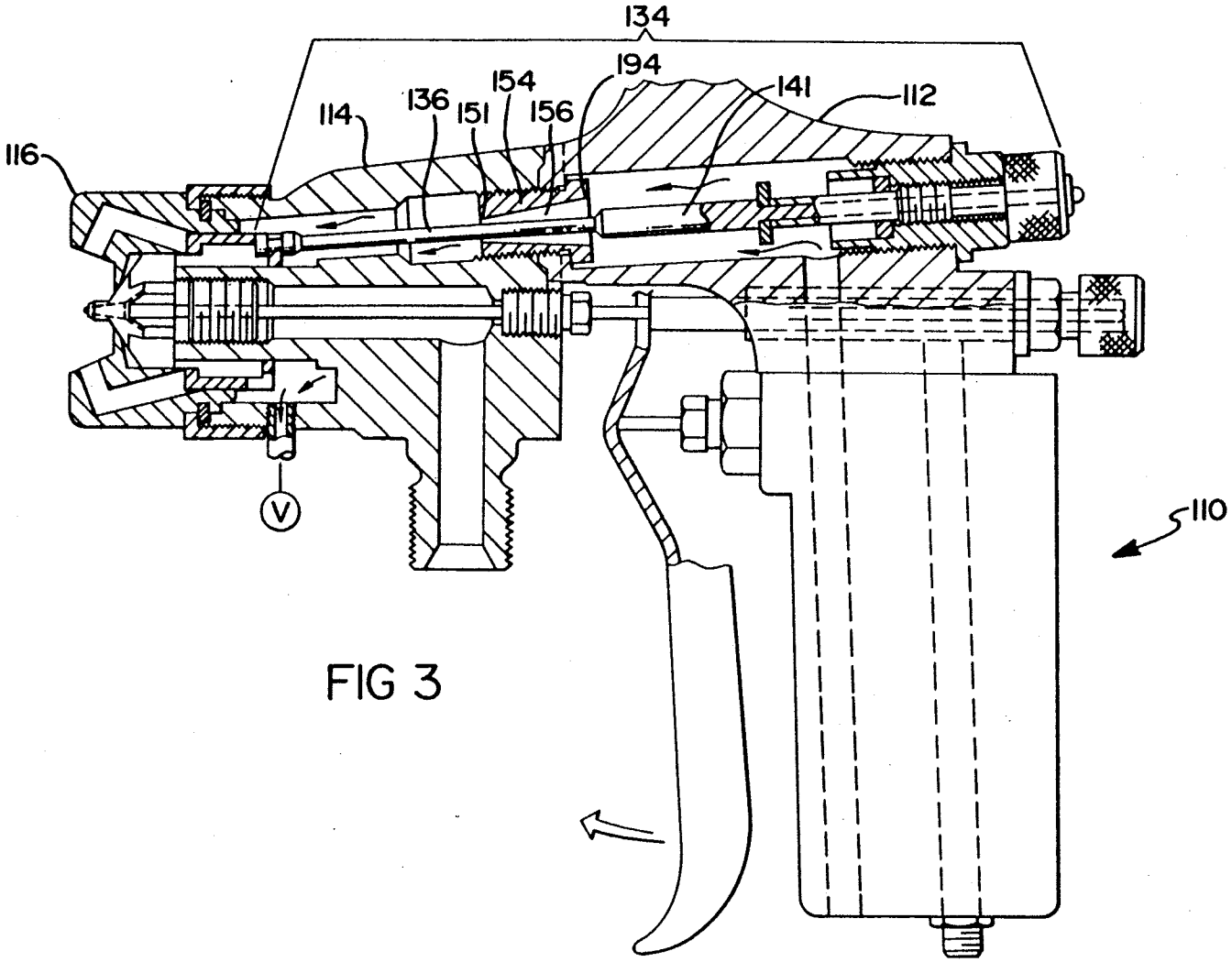

Referring now to FIG. 3, there is depicted a second embodiment of the spray gun 110 which includes a housing 112 with an assembly 114 joined to it via a bored bolt 154. The bolt 154 has its bore 156 tapered, such that the rearward end 194 is larger interfacing the first passage 126 of the housing than the forward end 151 which registers with the second passage 152 in the assembly 114. The tapering of the bore 156 of the bolt 154, along with the presence of means for restricting air flow 134 in the bore 151 of bolt 154, causes the air flow to be restricted in the bolt 154, thus lowering the pressure in the air cap 116. In all other respects, this embodiment is similar to that of FIGS. 1 and 2.

Figure 4:
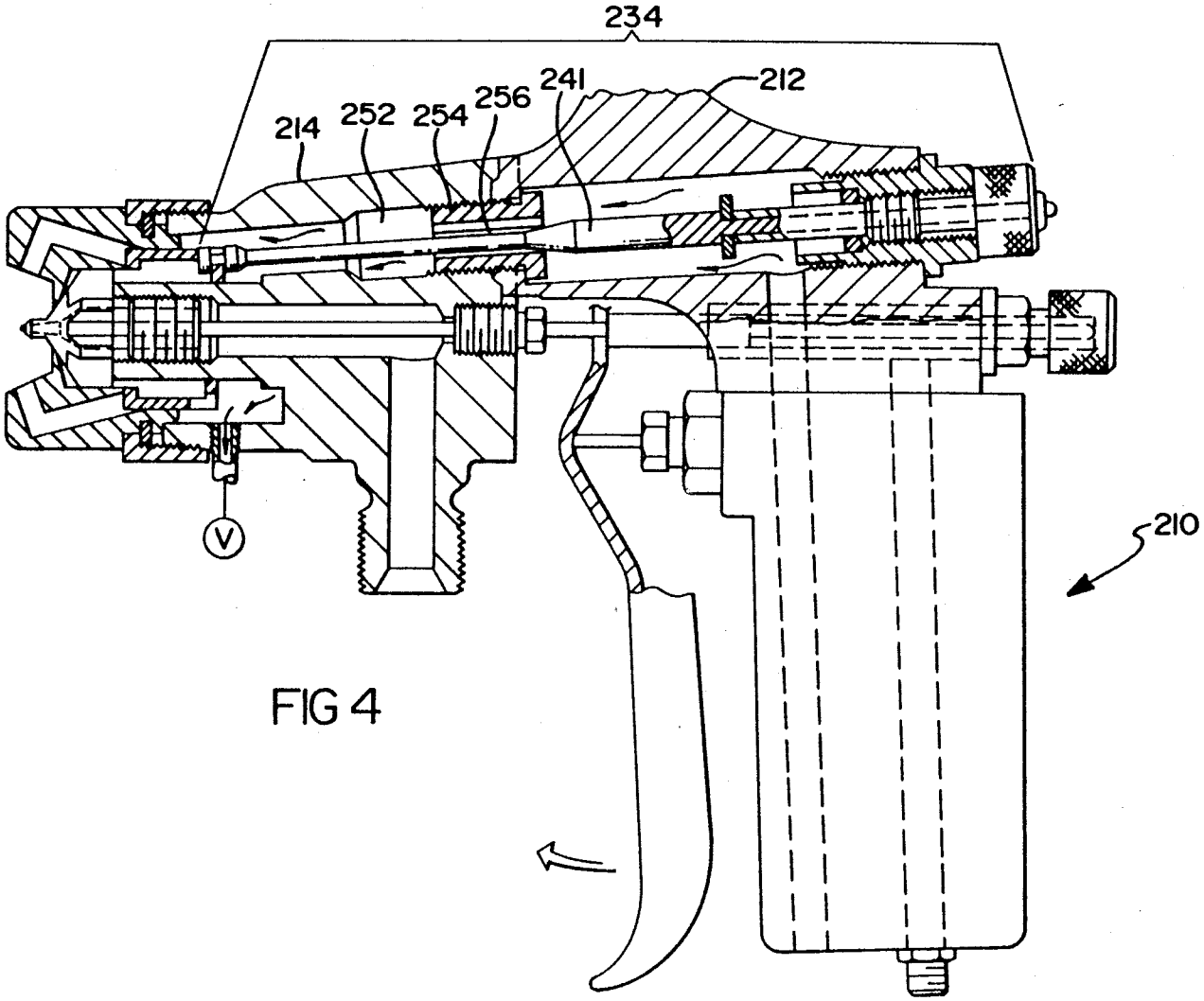
FIG. 4 is a cross-sectional view of a third embodiment of the present invention.

Referring now to FIG. 4, a third embodiment of the present invention is shown, where the spray gun 210 has an assembly 214 attached to the housing 212 by a bored bolt 254. The means for regulating air flow 234 has a tapered, raised circumference 241 along its medial section, reducing in circumference as the means 234 is followed forwardly, as shown. The control means 234 also passes through the bore 256 of the bolt 254, where the tapered raised circumference 241 of the means for regulating air flow 234 cooperates with the bolt 254 to restrict air flow, thus effecting a lower pressure at the air cap 216. In all other respects this spray gun operates in the same way as the other embodiments.

What is to be appreciated hereby is that an existing gun may be retrofitted to provide a reduced pressure paint spray gun. The retrofitting consists of a control rod, a modified control knob and appropriate fastener, alternate spray head fitted with valve and guide, and an alternate nozzle and mating aircap with attaching ring. Likewise, an entire new gun may be built in accordance herewith.

Having, thus, described the invention, what is claimed is:

1. A paint spray gun, comprising:

(a) a housing having:

(1) a first passage for directing pressurized air;

(2) means for restricting air flow disposed within the first passage;

(b) an assembly connected to the housing, the assembly comprising:

(1) a second passage for directing pressurized air, the second passage being in fluid communication with the first passage, the means for restricting air flow extending into the second passage;

(2) a central passage for delivering a sprayable material, (3) a chamber formed about the central passage and in fluid communication with the second passage;

(4) a slidably adjustable valve disposed within the chamber, the means for restricting air flow being attached to the valve to control movement thereof;

(5) a nozzle, in fluid communication with the central passage, the nozzle having a central bore for emitting the sprayable material, the nozzle being in fluid communication with the chamber, atomizing air being capable of flowing therepast; and (6) a needle valve disposed within the central passage and extending into the central bore of the nozzle;

(c) means for interconnecting the housing to the assembly, the means for restricting air flow extending therethrough;

(d) means for moving the needle valve; and (e) an air cap mounted on the assembly having channels in fluid communication with the chamber, the channels delivering fanning air to the material to be sprayed, the air cap having a central opening for delivering atomizing air past the nozzle.

2. The spray gun of claim 1, wherein the means for interconnecting comprises:

a bolt having a central bore formed therethrough, the bolt having a first end disposed within the first passage and a second end disposed within the second passage, the means for restricting air flow extending through the central bore of the bolt.

3. The spray gun of claim 2, wherein the cross-sectional area of the bore at the first end of the bolt is larger than the cross-sectional area of the bore at the second end of the bolt.

4. The spray gun of claim 1, wherein the means for restricting air flow comprises:

a rod, the rod comprising:

(a) means for attaching the rod to the valve disposed at a forward end of the rod;

(b) a raised circumference disposed about the medial portion of the rod; and wherein the rod extends through the means for interconnecting and through the second passage, and attaches to the valve.

5. The spray gun of claim 4, which further comprises a means for rotating the rod disposed at a rearward end of the rod.

6. The spray gun of claim 5, wherein the means for rotating comprises a knurled knob.

7. The spray gun of claim 4, wherein the means for interconnecting comprises:

a bolt having a central bore formed therethrough, the bolt having a first end disposed within the first passage and a second end disposed within the second passage, the means for restricting air flow extending through the bore.

8. The spray gun of claim 7, wherein the cross-sectional area of the bore at the first end of the bolt is larger than the cross-sectional area of the bore at the second end of the bolt.

* * * * *